US009190049B2

(12) United States Patent
Kaszczuk et al.

(10) Patent No.: US 9,190,049 B2
(45) Date of Patent: Nov. 17, 2015

(54) GENERATING PERSONALIZED AUDIO PROGRAMS FROM TEXT CONTENT

(71) Applicant: IVONA Software Sp. z.o.o., Gydnia (PL)

(72) Inventors: Michal T. Kaszczuk, Gdansk (PL); Lukasz M. Osowski, Gdynia (PL)

(73) Assignee: IVONA Software Sp. z.o.o., Gydnia (PL)

( * ) Notice: Subject to any disclaimer, the term of this patent is extended or adjusted under 35 U.S.C. 154(b) by 316 days.

(21) Appl. No.: 13/720,873

(22) Filed: Dec. 19, 2012

(65) Prior Publication Data

US 2014/0122079 A1 May 1, 2014

(30) Foreign Application Priority Data

Oct. 25, 2012 (PL) ..... P401346

(51) Int. Cl.

| | |
|---|---|
| ***G10L 13/00*** | (2006.01) |
| ***G10L 13/08*** | (2013.01) |
| ***G10L 21/00*** | (2013.01) |
| ***G10L 25/00*** | (2013.01) |
| ***G10L 13/02*** | (2013.01) |
| *G10L 13/033* | (2013.01) |

(52) U.S. Cl.
CPC ..... *G10L 13/02* (2013.01); *G10L 13/08* (2013.01); *G10L 13/033* (2013.01)

(58) Field of Classification Search
CPC ... G10L 15/22; G10L 17/22; G10L 2015/223; G10L 13/00; G10L 15/26; G10L 13/027; G10L 13/02; G10L 13/043; G10L 15/08; G10L 13/033; G10L 15/30; G06F 3/167
USPC ..... 704/258, 260, 261, 270, 270.1, 275, 704/277
See application file for complete search history.

(56) References Cited

U.S. PATENT DOCUMENTS

| | | | | |
|---|---|---|---|---|
| 6,671,617 | B2 * | 12/2003 | Odinak et al. | 701/420 |
| 7,454,348 | B1 * | 11/2008 | Kapilow et al. | 704/269 |
| 8,473,297 | B2 * | 6/2013 | Jang et al. | 704/260 |
| 2002/0087224 | A1 * | 7/2002 | Barile | 700/94 |
| 2003/0004711 | A1 * | 1/2003 | Koishida et al. | 704/223 |
| 2005/0234958 | A1 * | 10/2005 | Sipusic et al. | 707/102 |
| 2006/0095848 | A1 * | 5/2006 | Naik | 715/716 |
| 2007/0124142 | A1 * | 5/2007 | Mukherjee | 704/235 |
| 2007/0156410 | A1 * | 7/2007 | Stohr et al. | 704/275 |
| 2008/0140406 | A1 * | 6/2008 | Burazerovic et al. | 704/260 |
| 2008/0141180 | A1 * | 6/2008 | Reed et al. | 715/854 |
| 2009/0202226 | A1 * | 8/2009 | McKay | 386/104 |
| 2009/0254345 | A1 * | 10/2009 | Fleizach et al. | 704/260 |

(Continued)

FOREIGN PATENT DOCUMENTS

WO WO 2011/088053 A2 7/2011

*Primary Examiner* — Edgar Guerra-Erazo
(74) *Attorney, Agent, or Firm* — Knobbe, Martens, Olson & Bear, LLP

(57) ABSTRACT

Features are disclosed for generating text-to-speech (TTS) audio programs from textual content received from multiple sources. A TTS system may assemble an audio program from several individual audio presentations of user-selected network-accessible content. Users may configure the TTS system to retrieve personal content as well as publically accessible content. The audio program may include segues, introductions, summaries, and the like. Voices may be selected for individual content items based on user selections or on characteristics of the content or content source.

31 Claims, 5 Drawing Sheets

(56) References Cited

U.S. PATENT DOCUMENTS

| | | | | |
|---|---|---|---|---|
| 2009/0326948 | A1* | 12/2009 | Agarwal et al. | 704/260 |
| 2010/0050064 | A1* | 2/2010 | Liu et al. | 715/202 |
| 2010/0082328 | A1* | 4/2010 | Rogers et al. | 704/8 |
| 2010/0082344 | A1* | 4/2010 | Naik et al. | 704/258 |
| 2011/0106283 | A1* | 5/2011 | Robinson | 700/94 |
| 2011/0124264 | A1* | 5/2011 | Garbos | 446/147 |
| 2011/0153330 | A1* | 6/2011 | Yazdani et al. | 704/260 |
| 2011/0161085 | A1* | 6/2011 | Boda et al. | 704/260 |
| 2011/0167390 | A1* | 7/2011 | Reed et al. | 715/854 |
| 2011/0313757 | A1* | 12/2011 | Hoover et al. | 704/9 |
| 2012/0191457 | A1* | 7/2012 | Minnis et al. | 704/260 |
| 2013/0124202 | A1* | 5/2013 | Chang | 704/235 |

* cited by examiner

GENERATING PERSONALIZED AUDIO PROGRAMS FROM TEXT CONTENT

BACKGROUND

Text-to-speech (TTS) systems convert raw text into sound using a process sometimes known as speech synthesis. In a common implementation, a TTS system may comprise a computing device configured to receive text input and provide an audio presentation of the text input. Some TTS systems provide a number different language modules and voice modules. Language modules enable a TTS system to receive and process text in a written language, such as American English, German, or Italian. Voice modules enable a TTS system to output an audio presentation in a specific voice, such as French female, Spanish male, or Portuguese child.

TTS systems first preprocess raw text input by disambiguating homographs, expanding abbreviations and symbols (e.g., numerals) into words, and other such operations. The preprocessed text input can be converted into a sequence of words or subword units, such as phonemes or diphones. The resulting sequence is then associated with acoustic and/or linguistic features of a number small speech recordings, also known as speech segments. The phoneme sequence and corresponding acoustic and/or linguistic features are used to select and concatenate recorded and synthetic speech segments into an audio presentation of the input text.

TTS systems may be configured to generate audio presentations from message text, such as electronic mail (email) and text messages, and play back the audio presentations to a user. Some applications that include TTS functionality facilitate entry of network addresses of content, such as uniform resource locators (URLs). Such applications may be configured to retrieve text content from the location corresponding to the entered URL, generate an audio presentation of the content, and transmit or playback the audio presentation to a user.

BRIEF DESCRIPTION OF DRAWINGS

Throughout the drawings, reference numbers may be reused to indicate correspondence between referenced elements. The drawings are provided to illustrate example embodiments described herein and are not intended to limit the scope of the disclosure.

DETAILED DESCRIPTION

Introduction

Figure 1:
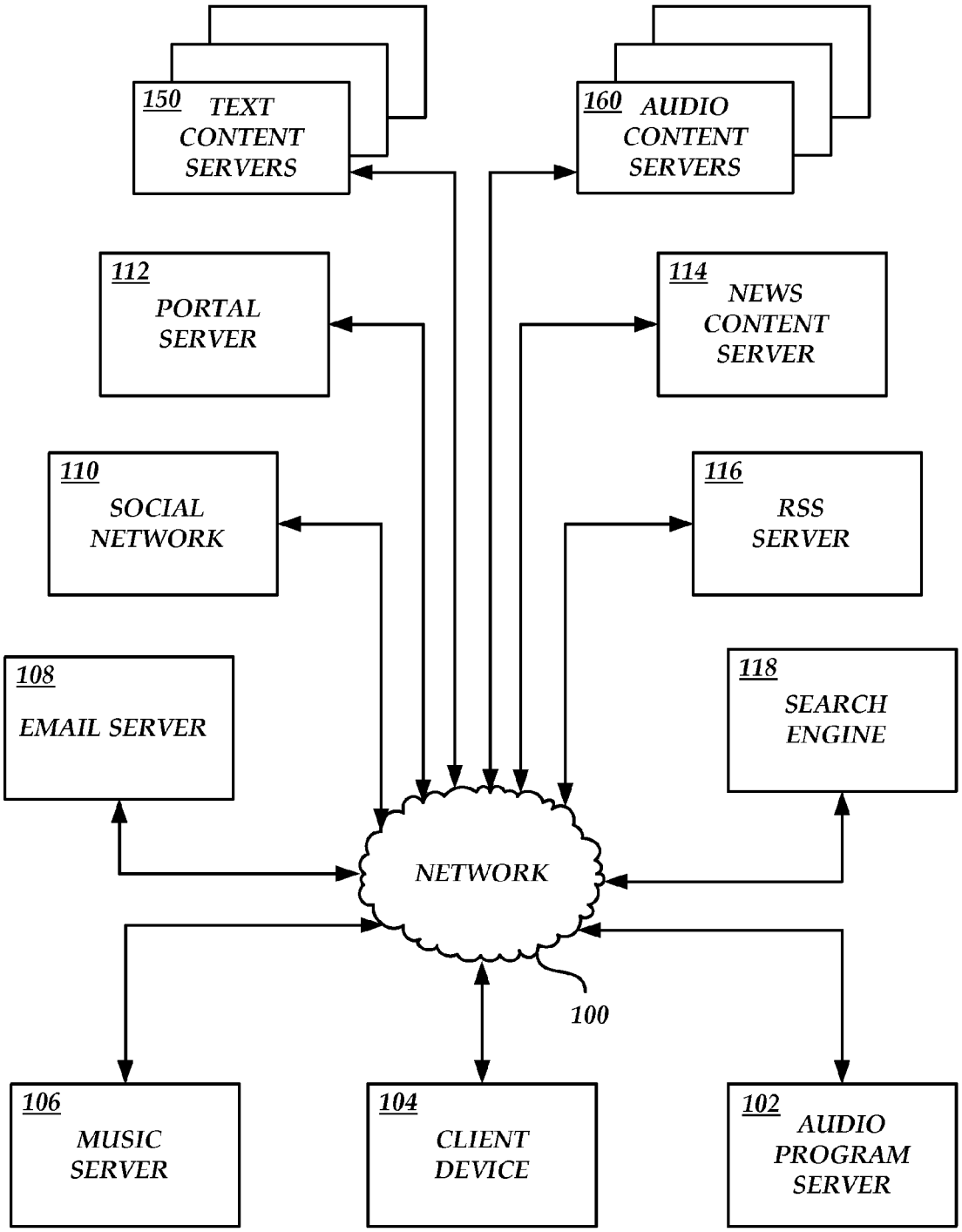
FIG. 1 is a block diagram of an illustrative network computing environment including an audio program server, a client device, and several different providers of textual content.

Generally described, the present disclosure relates to speech synthesis systems. Specifically, aspects of the disclosure relate to generating text-to-speech (TTS) audio programs from textual content received from multiple sources. A TTS system may assemble an audio program from several individual audio presentations of user-selected content. Users may configure the TTS system to retrieve personal content, such as electronic mail (email) and social network messages, as well as publically accessible content, such as the news, for processing and inclusion in the audio program. The audio program may include segues, introductions, summaries, and the like.

Additional aspects of the disclosure relate to selecting voices from which to generate the individual audio presentations. The selection may be automatic and based on the source of the content, such as using various male and female voices for emails from senders of the corresponding gender. Additional or alternative factors that may be considered when selecting a voice include the subject of the content and user preferences. For example, hard news stories may be presented by alternating male and female voices configured to speak in the informative style of live newscasters, while opinion or entertainment columns may be presented by voices configured to sound more friendly or humorous. Users may also select a voice to be used, such as for a general type of content or for a specific source.

Although aspects of the embodiments described in the disclosure will focus, for the purpose of illustration, on interactions between a client device, an audio program server, and a number of content servers, one skilled in the art will appreciate that the techniques disclosed herein may be applied to any number of hardware or software processes or applications. Further, although various aspects of the disclosure will be described with regard to illustrative examples and embodiments, one skilled in the art will appreciate that the disclosed embodiments and examples should not be construed as limiting. Various aspects of the disclosure will now be described with regard to certain examples and embodiments, which are intended to illustrate but not limit the disclosure.

With reference to an illustrative embodiment, a user may access a user interface provided by or associated with an audio program server. The user may indicate or select network-accessible content from any number of sources for inclusion in the audio program generated for the user. The content may include publically accessible content, such as the content pages and Really Simple Syndication (RSS) feeds provided by news, sports, and entertainment content providers. The content may also be personal, such as email, social network messages, and the like. The audio program server may process the selected content to extract the meaningful portion (e.g.: the text of the article) and exclude portions which are not to be included in the audio presentation (e.g.: advertisements). The content may also include content that already exists in audio format, such as audio books.

The audio program server may include a TTS system for generating audio presentations from text input. A TTS system may include tens or hundreds of different voices and different languages. Users may select which voices to use for each content type or source, or the audio program server may automatically select an appropriate voice. For example, a user's email messages from senders detected as being female based on the sender's name may converted into audio presentation using female voice. Different female voices may be used for messages from different female senders. News-related and other informative content may be converted into audio presentations using neutral sounding voices, while sports and entertainment content may be converted into presentations using more lively sounding voices. The text itself may be analyzed as well. More somber news stories may be converted into presentations using voices which sound serious or hushed, and the speed may be adjusted to reflect the somber mood of the content. The speed and tone of lighter stories may also be adjusted accordingly.

The audio program server may assemble the audio presentations into a single audio program. Segues may be included between audio presentations. The segues may include music from a user's local device, from a network-accessible music storage, or they may be chosen from a group of segues provided by the audio program server. Additionally, summaries may be included. For example, a summary may be inserted at the beginning of the audio program, and may inform the user about which content the program contains (e.g.: 2 emails, 3 news stories, and 4 social network messages).

The generated audio programs may be delivered to the user in any appropriate method. For example, the audio program may be streamed to a user device from the audio program server, transmitted as a single file or group of files, or distributed through a newscast distribution network. A user may use an audio program playback application that includes controls for rewinding, fast-forwarding, skipping audio presentations, repeating audio presentations, or selecting an individual audio presentation to play. In some embodiments, the audio program playback application may accept voice input and perform audio program navigation through the use of speech recognition.

Controls or voice commands may be enabled to allow a user to tag or otherwise select an audio presentation for further action. For example, an audio program may include an email message that a user would like to tag for follow-up. The user may activate a control, speak a voice command, or perform some other user interface action to tag the email. The user's email server may then be updated or notified to add a tag to the email so that the email will be tagged when the user subsequently accesses the email, such as via an email client on a personal computing device. The tagging feature is not limited to emails. Users may tag any content item and receive a subsequent notification regarding the tagged item. For example, an audio program may include an audio presentation of a content item. A user may perform some user interface action to tag the content. An email or notification may be sent to the user with a link to the content or the text of the content on which the audio presentation was based. In some cases, the user's account with the audio program server may be updated to reflect the tagged content. For example, the user may subsequently access an account profile page, and links, notifications, or other information about tagged content items may be presented to the user.

Network Computing Environment

Prior to describing embodiments for generating audio programs based on user selected content in detail, an example network computing environment in which these features can be implemented will be described. FIG. 1 illustrates a network computing environment including an audio program server 102, a client device 104, and multiple content providers 106-118 in communication via a network 100. In some embodiments, the network computing environment may include additional or fewer components than those illustrated in FIG. 1. For example, the number of content providers 106-118 may vary substantially and the audio program server 102 may communicate with two or more client devices 104 substantially simultaneously.

The network 100 may be a publicly accessible network of linked networks, possibly operated by various distinct parties, such as the Internet. In other embodiments, the network 100 may include a private network, personal area network, local area network, wide area network, cable network, satellite network, etc. or some combination thereof, each with access to and/or from the Internet.

The audio program server 102 can include any computing system that is configured to communicate via network 100. For example, the audio program server 102 may include a number of server computing devices, desktop computing devices, mainframe computers, and the like. In some embodiments, the audio program server 102 can include several devices or other components physically or logically grouped together.

The client device 104 may correspond to any of a wide variety of computing devices, including personal computing devices, laptop computing devices, in-car dashboard systems, hand held computing devices, terminal computing devices, mobile devices (e.g., mobile phones, tablet computing devices, etc.), wireless devices, electronic book readers, media players, and various other electronic devices and appliances. A client device 104 generally includes hardware and software components for establishing communications over the communication network 100 and interacting with other network entities to send and receive content and other information.

Various content providers 106-118 may be accessed via the network 110. For example, a music server 106 may be configured to store, sell, stream, or otherwise provide access to music. A user of a client device 104 may obtain an account with the music server 106, and may therefore have access to at least a portion of the music hosted by the music server 106. The audio program server 102 may retrieve music associated with the user to use for segues and introductions in the generated audio programs. A user may also have an account with an email server 108, such as a server configured to provide simple mail transfer protocol (SMTP) access to email messages. The user may authorize the audio program server 102 to retrieve email messages from the email server 108 for inclusion in audio programs generated for the user. In addition, a user may have an account with a social network 110, such as a system configured to facilitate communication and content sharing between groups of users. The user may authorize the audio program server 102 to retrieve messages and other content associated with the user from the social network 110.

Publically accessible content providers, such as a portal server 112, news content provider 114, RSS server 116, search engine 118, and any number of other text content servers 150, audio content servers 160, and the like may also be accessed by the audio program sever 102. The example content providers, servers, and hosts illustrated in FIG. 1 and described herein are illustrative only and not meant to be limiting. In practice, any network-accessible textual content may be included in an audio program generated by the audio program server. In some embodiments, content may be transferred from the client device 104 to the audio program server 102 for inclusion in an audio program. For example, a client device 104 may transfer email, social network info, and the like to the audio program server 102 in text format so that the audio program server 104 doesn't need authorization to get it directly from the corresponding email server 108, social network 110, or other provider. In some embodiments, content that is not text-based may be converted to text (e.g.: optical character recognition applied to a scanned document), and content that is not network-accessible may be loaded onto a content server. Content that is already in audio form (e.g.: audio books, recorded news casts) may retrieved from an audio content server 160, the client device 104, or some other source and may be included in an audio program with text-to-speech content.

Figure 2:
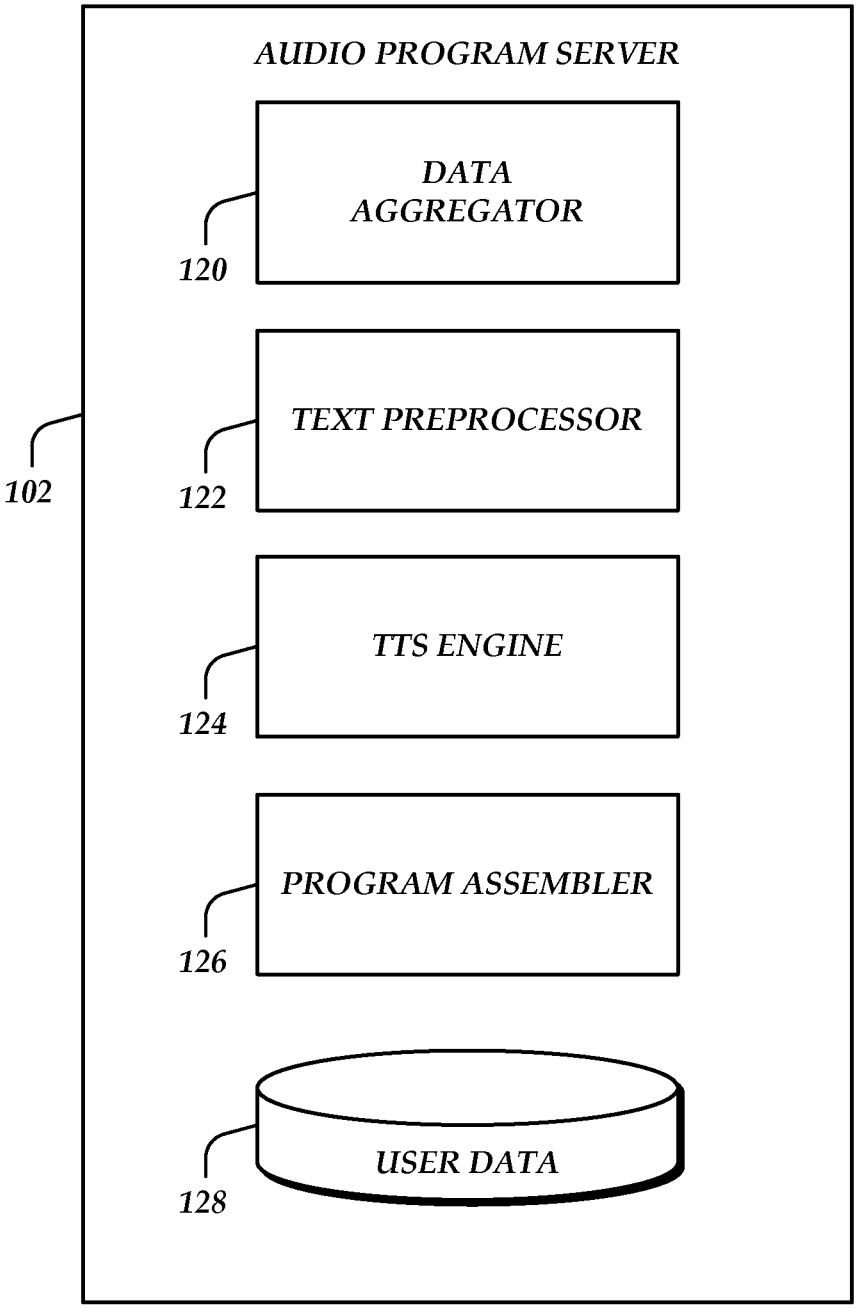
FIG. 2 is a block diagram of an illustrative audio program server, including several components for generating audio programs.

Turning now to FIG. 2, an illustrative audio program server 102 will be described. An audio program server 102 may include a number of components to facilitate retrieval of content on behalf of or otherwise at the request of a user. The audio program server 102 may then generate one or more audio programs based on the retrieved content. The audio program server 102 of FIG. 2 includes a data aggregator 120, a text preprocessor 122, a TTS engine 124, a program assembler 126, and a user data store 128. In some embodiments, the audio program server 102 may have additional or fewer components that those illustrated in FIG. 2.

The data aggregator 120, text preprocessor, TTS engine 124, and program assembler 126 may be implemented on one or more application server computing devices. For example, each component may be implemented as separate hardware component or as a combination of hardware and software. In some embodiments, two or more components may be implemented on the same physical device.

The user data store 128 may be implemented on a database server computing device configured to store records, audio files, and other data related to the generation of audio presentations and the assembly of audio programs based on the audio presentations and other content. In some embodiments, the audio program server 102 may include a server computing device configured to operate as a remote database management system (RDBMS). The user data store 128 may include one or more databases hosted by the RDBMS. The user data store 128 may be used to store user selections of content, user passwords for personalized or private content such as email, and other such data. The data aggregator 120, program assembler 126, and other components of the audio program server 102 may access the data in the user data store 128 in order to determine, among other things, which voices to use or the order of the audio presentation within the assembled audio program.

In operation, the data aggregator 120 may access the user data store 128 to determine the content sources 106-118 from which to retrieve data for processing. Once the data aggregator 120 has received a content item, it may process the content in order to extract the text on which an audio presentation will ultimately be based. Extraction of such meaningful textual content from a content page that may include superfluous or other undesirable content (e.g.: advertisements, reader comments) may be performed using web scraping techniques or according to other techniques known to those of skill in the art. The data aggregator 120 may also prepare a summary of all content that is to be included in the audio program. For example, the data aggregator 120 may calculate the number and type of each content item received. A summary may include high level detail such as the number of personal messages, the number of news articles, etc. The summary may be prepared as plain text to facilitate conversion by the text preprocessor 122 and TTS engine 124.

The text preprocessor 122 may be configured to receive the raw text input from the data aggregator and process it into a form more suitable for text-to-speech conversion by the TTS engine 124. The preprocessing may include expansion of abbreviations and acronyms into full words. Such expansion may be particularly useful for certain types of network-accessible content (e.g.: email, social network posts, micro blogs). Other types of network-accessible content may be summarized or otherwise distilled from a full text form. For example, attachments to emails may be summarized according to various natural language understanding (NLU) algorithms so that they may be briefly described in the audio program without consuming more program time and storage space than may be desirable and for the convenience of the listener.

The TTS engine 124 may be configured to process input from the text preprocessor 122 and generate audio files or steams of synthesized speech. For example, when using a unit selection technique, a TTS engine 124 may convert text input into a sequence of subword units, associate acoustic and/or linguistic features with the subword units of the sequence, and finally arrange and concatenate a sequence of recorded or synthetic speech segments corresponding to the acoustic and/or linguistic features and the sequence of subword units. The TTS processing described herein in meant to be illustrative only, and not limiting. Other TTS processes known to those of skill in the art may be utilized (e.g., statistical parametric-based techniques, such as those using hidden Markov models).

The program assembler 126 can obtain user data 128 and the various audio presentations generated by the TTS engine 124. The program assembler 126 may then arrange the audio presentations, as well as segues, introductions, pre-existing audio content, and the like according to user preferences. For example, the program assembler may retrieve music files associated with the user or otherwise accessible by the audio program server 102. The music files may be included between individual audio presentations. The program assembler 126 or some other component of the audio program server may then transmit or stream the audio program to the user or some user-accessible location.

User Configuration of an Audio Program

Figure 3:
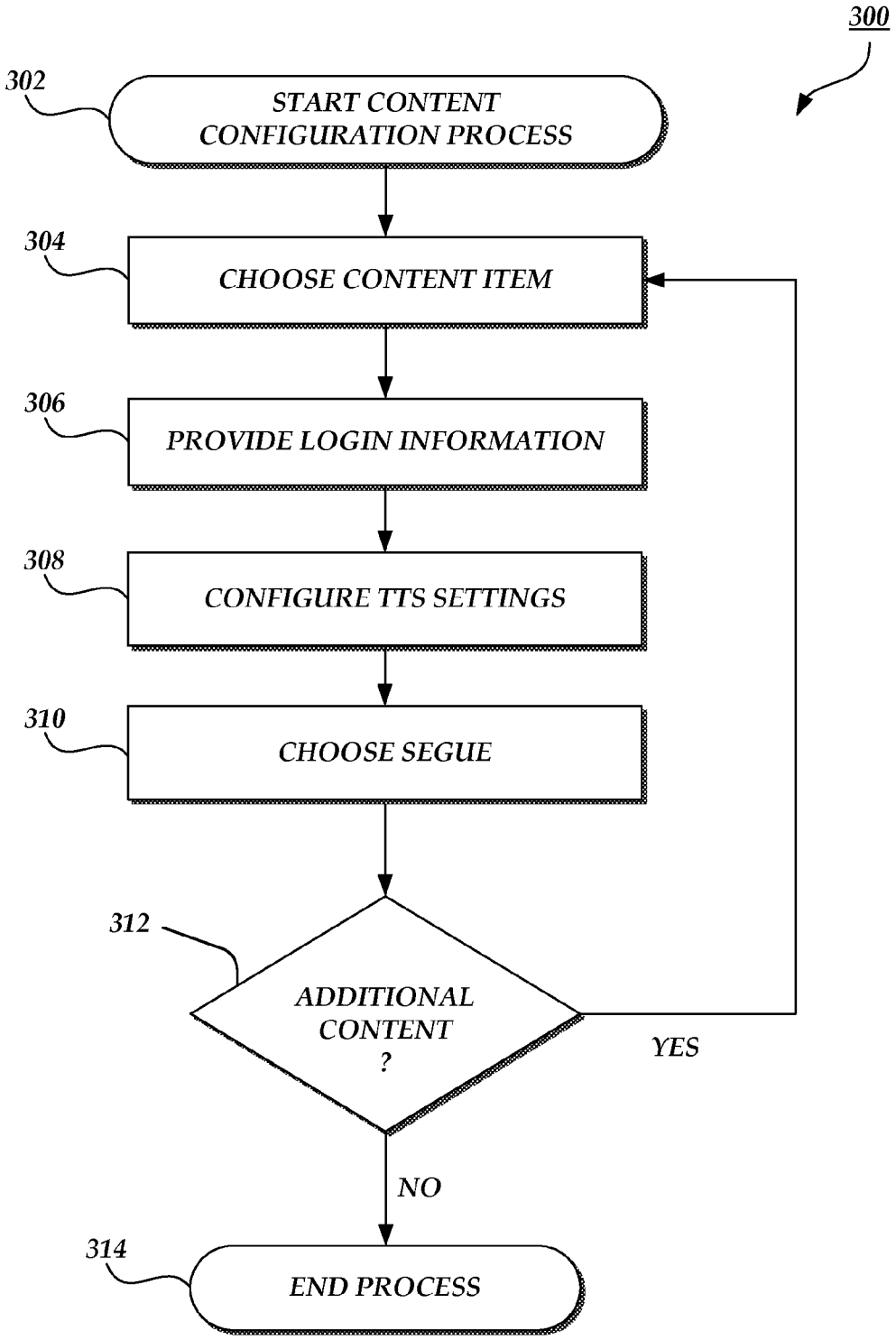
FIG. 3 is a flow diagram of an illustrative process for configuring a user account with an audio program server.

Turning now to FIG. 3, an illustrative process 300 for facilitating user configuration of an audio program will be described. The process 300 may be implemented on a client device 104. A user may request a content page corresponding to the user interface of the audio program server 102, load a program on the client device 104 that communicates with the audio program server 102, or otherwise access an interface with the audio program server 102. The user may select content for inclusion in a subsequent audio program, or configure other settings with respect to the assembly of audio programs. In some embodiments, a user may select recorded audio content to be included in the audio program, such as recorded newscasts, in addition to text content that will be converted to an audio presentation. The recorded audio content may be included in the audio program along with the audio presentations generated by the TTS engine 124.

The process 300 of configuring user data regarding an audio program begins at block 302. The process 300 may be executed by a local browser component or by a program stored on the client device 104 and associated with the audio program server 102. In some embodiments, the process 300 may be embodied in a set of executable program instructions and stored on a computer-readable medium drive associated with the client device 104. When the process 300 is initiated, the executable program instructions can be loaded into memory, such as RAM, and executed by one or more processors of the client device 104.

At block 304, the user may indicate a choice for a content item to be included in the user's audio program. For example, the user may enter a URL, select a content source from a listing of predetermined content sources, or otherwise provide the audio program server 102 with information regarding the location of the selected content. Advantageously, the user need not specify each individual content item to include in the audio program. The user may instead provide an indication of which content portion of the content items (e.g.: a display portion of a content page) the user wishes to include. For example, a content page may include a number of textual components, such as headlines, a main article, and other information. One user may select the main article for inclusion, while another user may choose to have the top headlines read for the audio program. In some embodiments, the user may select an automated content distribution service, such as RSS feed. When the audio program is generated, the audio program server 102 may obtain the most recent content associated with the RSS feed for inclusion in the audio program. Additionally, predefined content queries and searches may be added to the audio program. As with RSS feeds, the audio program server 102 may execute the query at the time of audio program generation and include the most recent and/or relevant results in the audio program.

At block 306, the user may provide login information or provide authorization to the audio program server 102 in cases when the selected content is password protected or otherwise private. Some content servers require additional information for accessing private data, such as personal questions or image recognition. The user may provide additional information, such as the security information that the user has proved to the content provider.

At block 308, the user may determine TTS configuration settings for the current content. The TTS configuration settings may include which voice to utilize when generating an audio presentation of the content or which speed or other effect to apply to the voice. Additional configuration settings may include identifying a position within the audio program sequence to insert the audio presentation of the content or whether to summarize the content or portions thereof (e.g.: email attachments) with automated NLU techniques.

At block 310, the user may identify a segue to precede or follow the content. Segues may be audio clips from music supplied by the audio program server 102, supplied by the user, or supplied by a network-accessible service. For example, a user may have access to a number of music files on the local client device 102. The user may upload a particular music file to the audio program server 102 and indicate which portion or portions of the music file to use as a segue. If a music file is stored in a network-accessible location, such as a music server 106, the user may provide information to access the music file, such as a URL, internet protocol (IP) address, or some other information with which to identify the location of the music file.

At decision block 312 the user may determine whether there is additional content to add to or configure for the audio program. If there are more content items, the process 300 may return to block 304 as many times as necessary to add each desired content item or to configure each previously added content item. Otherwise, the process 300 may proceed to block 314, where execution terminates. In some embodiments, the user may select general configuration properties associated with the audio program. For example, the user may specify a preferred delivery method or location, a delivery schedule, and other such configuration settings.

Assembly of Audio Programs

Figure 4:
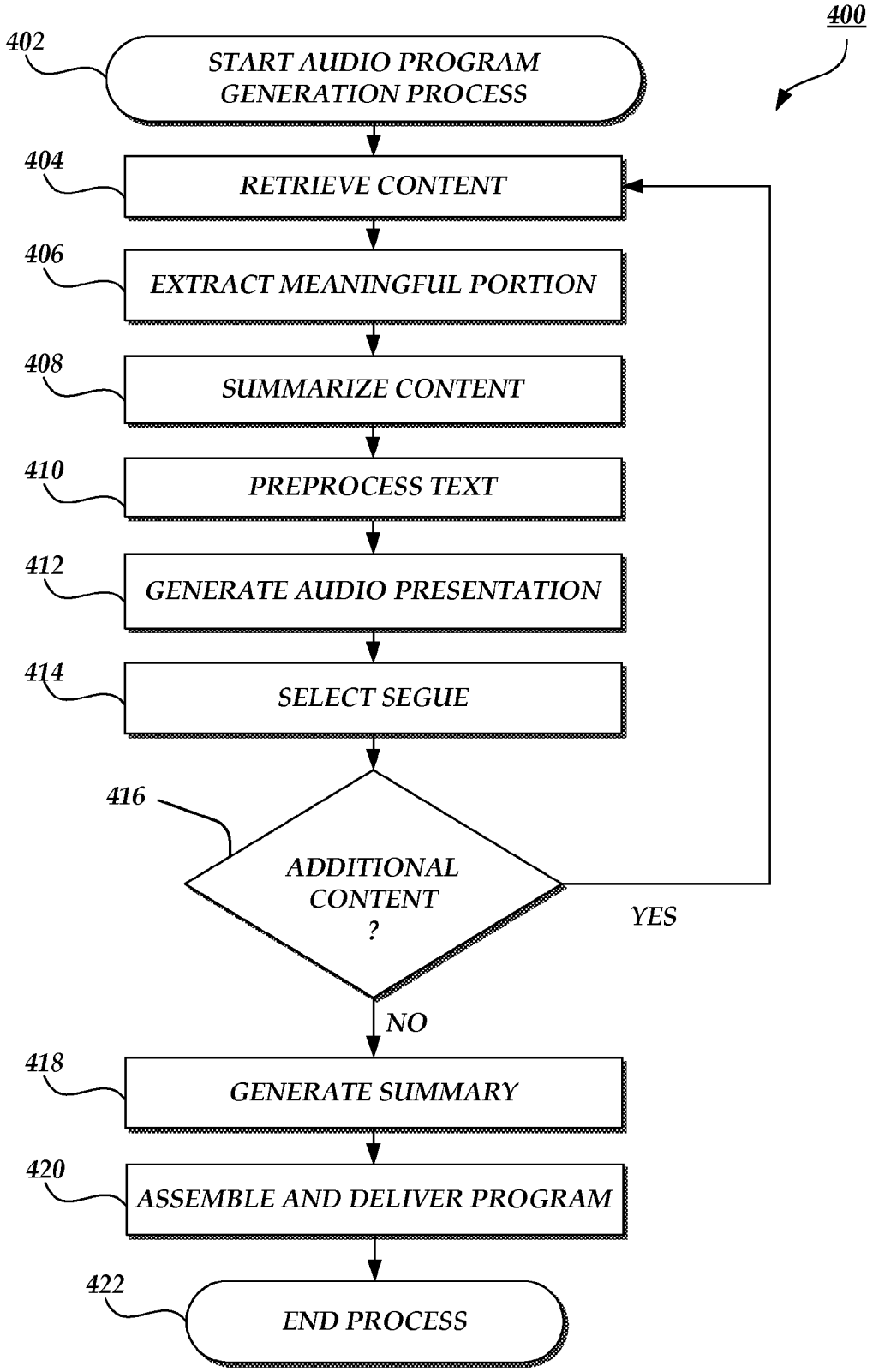
FIG. 4 is a flow diagram of an illustrative process for generating an audio program based on a user configuration.

Turning now to FIG. 4, an illustrative process 400 for generating audio programs of user-selected content will be described. The process 400 may be implemented by an audio program server 102 or some component or components thereof. The audio program server 102 may retrieve user-selected content items, generate audio presentations of the content items, assemble the content items into an audio program, insert segues and summaries, and perform other activities related to the generation of audio programs. Advantageously, the audio program server 102 may utilize any number of different voices when generating audio presentations of the individual content in order. The determination may be based on user selections or automated analysis of characteristics of the content.

The process 400 begins at block 402. In some embodiments, the process 400 may be embodied in a set of executable program instructions and stored on a computer-readable medium drive associated with a computing system. When the process 400 is initiated, the executable program instructions can be loaded into memory, such as RAM, and executed by one or more processors of the computing system. In some embodiments, the computing system may encompass multiple computing devices, such as servers, and the process 400 may be executed by multiple servers, serially or in parallel. Initiation of the process 400 may occur in response to an on-demand request from a user, according to a schedule, or in response to some event. For example, an audio program may be generated each morning and transmitted to a user prior to the user's commute to work.

At block 404, the data aggregator 120 may retrieve a content item according to the selections of the user. The data aggregator 120 may load or access data in the user data store 128 associated with the user and with the current audio program. The data may indicate a URL or other address to use in order to retrieve the content. The content items may be retrieved according to the order in which they will be placed in the audio program, or in some other order. Some content items may private, and may therefore require a password in order to retrieve them. For example, email messages, social network messages and posts, and other personalized or sensitive content may require the data aggregator 120 to present a password or some other form of authorization. A password may have been previously supplied by the user and stored within the user data store 128. The data aggregator 120 may retrieve the password from the data store 128 and pass it to the content server. SMTP servers may be configured to accept passwords without user interaction. For other types of content, the data aggregator may generate a Hypertext Transfer Protocol (HTTP) POST request that includes the password, or it may use some other technique.

At block 406, the data aggregator 120 may extract the meaningful portion of the content item. Many content items include meaningful textual content and a number of additional elements (e.g.: advertisements, reader comments, image captions) which are not to be included in the audio presentation of the content. The user may have defined the interesting section when configuring the content item, as described above with respect to FIG. 3. In some cases, the data aggregator 120 may apply automatic algorithms and techniques known to those of skill in the art. For example, the data aggregator 120 may inspect Hypertext Markup Language (HTML) code associated with the content. The data aggregator 120 may look for certain HTML tags which have more textual data than others, and other similar techniques. The output from the data aggregator 120 may be a raw text file, stream, or memory space that is provided to the text preprocessor 122 or some other component of the audio program server 102.

At block 408, the text preprocessor 122 may summarize content with a size exceeding a threshold, content which is a specific type, content that the user has indicated should be summarized, etc. Summaries may be useful for lengthy content, linked content, and attached content. Additionally, if a user selects a large number of content items to include in the audio presentation, one or more of the content items may be summarized in order to conserve storage space, bandwidth, computing capacity, and to ensure that the resulting audio program is not too long.

At block 410, the text preprocessor 122 may further process the text into a format suitable for input to a TTS engine. Preprocessing may include expansion of abbreviations and symbols into their full word representations. This may be useful for certain kinds of text, such as email messages and social network postings, which may include abbreviations or symbols, such as smiley faces. Additional preprocessing actions may include disambiguation of homographs, translation of embedded foreign text, and the like. The preprocessed text may be provided to the TTS engine 124.

At block 412, the TTS engine 124 may generate an audio presentation of preprocessed text input by utilizing voice data corresponding to a selected or desired voice. An audio presentation of each content item may be generated utilizing the same voice. In some embodiments, audio presentations may be generated utilizing two or more different voices. The voice for any particular content item may be selected based on user data retrieved from the user data store 128, determined by the user as described above.

Figure 5:
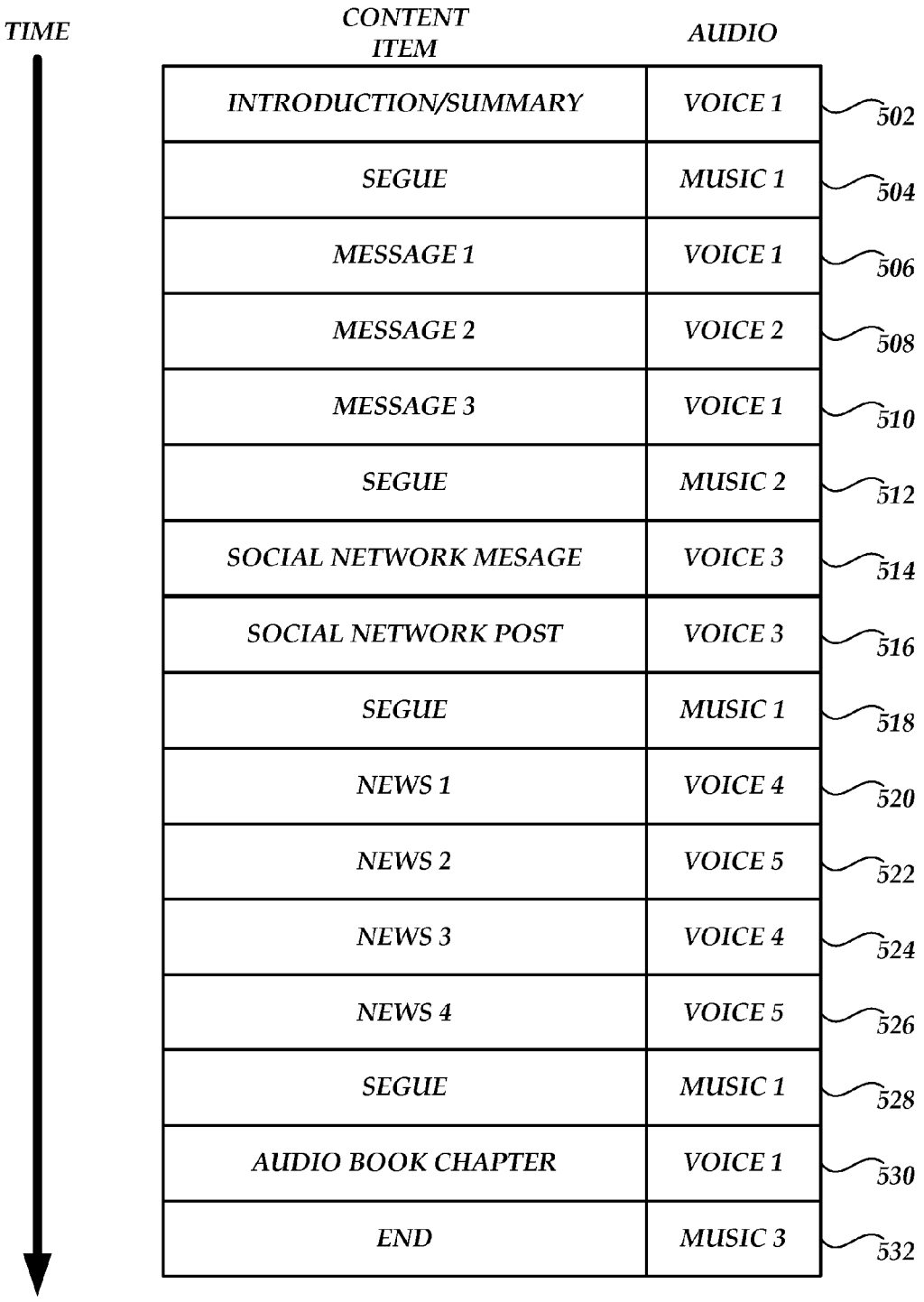
FIG. 5 is a block diagram of an illustrative audio program comprising several audio presentations of text in different voices.

In some cases a voice may be automatically selected by the TTS engine 124 or some other component of the audio program server 102. The selection may be based on characteristics of the content or the content source. For example, email messages from females may be converted to an audio presentation by utilizing a female voice. Messages from different females may be associated with different voices randomly or according to some additional characteristic of the content, such as its subject matter. FIG. 5 illustrates an example audio program including multiple individual audio presentations of content items. As shown in FIG. 5, the audio presentation of email message 1 506 and email message 3 510 have been generated using voice 1, while the audio presentation of email message 2 508 has been generated using voice 2. In this example, voice 1 may correspond to a female voice, while voice 2 corresponds to a male voice. The sender of messages 1 506 and 3 510 may have been a single female or two different females, while the sender of message 2 508 may have been a male. Similar techniques may be utilized to determine voices for social network messages and posts. Other content, such as news articles, may include an indication of the content author. Voices may be selected based on the content author in a similar manner.

Additional characteristics of the content may influence the selection of a voice. For example, the subject matter of the content may be more suited to some voices than others. Individual voices may provide better performance (e.g.: more natural sounding results) for long passages of text, while others provide better performance for specific vocabulary (e.g.: highly technical content). As described above, the tone of the content may also be considered. Audio presentations of somber content, such as certain news articles, may be generated utilizing appropriately somber or neutral adult voices rather than voices based on children's speech patterns.

The speed of the voice or the resulting audio presentation may also be customized. Returning to the news example, audio presentations of certain news stories may be generated with longer pauses, slower speech patterns, and the like. In contrast, audio presentations of entertainment news or sports scores may be generated with shorter pauses and faster speech patterns.

The voices selected for other audio presentations to be included in the audio program may also be considered. For example, block 412 may be executed separately, either sequentially or in parallel, for each individual content item that is to be included in the audio program. If two or more news articles are selected, then different voices may be utilized in order to prevent monotony or enhance the naturalness of the audio program. Live news casts often include two or more individuals reading the news. This characteristic may be mimicked in the audio program by selecting two or more voices with the appropriate tone for news content, such as an adult male voice and an adult female voice each configured to sound neutral and informative. Each news article (or other content item) may be associated with the multiple voices. The voice that is used to generate the audio presentation may also be selected based on which voice was used for the preceding or subsequent audio presentation, among other factors. As shown in FIG. 5, audio presentations of news articles 1 520 and 3 524 have been generated using voice 4. The audio program server 102 accordingly selected voice 5 to generate the audio presentations of news articles 2 and 4 522, 526.

In some embodiments, two or more voices may be used to generate an audio presentation of a single content item. For example, a content item may include dialogue between two individuals, such as an interviewer and an interviewee. A voice may be assigned to each of the individuals, and the audio presentation of the content item may therefore mimic a conversation rather than a narration. The portion of the content that corresponds to the first individual (e.g.: the interviewer) can be processed into the audio presentation by using a first voice, and the portion that corresponds to the second individual (e.g.: the interviewee) can be processed using the second voice. Quotations in content items, such as news articles, may be presented in a similar fashion, with the main article text processed using the voice that is selected for the article, and quotations from one or more individuals processed using voices selected for each of the individuals. The quotations can be detected based on the formatting of the original document or the presence of quotation marks or certain words (e.g.: said) preceding or following a sentence or other grouping of words.

In some embodiments, voices may be selected for some or all of the individuals based on characteristics associated with the individual as determined from the text, such as gender, age, and the like. In additional embodiments, voices may be selected for some or all of the individuals based on NLU or other processing of the text attributed to an individual, such as the meaning of the text, the subject matter of the text, or other characteristics.

At block 414, a segue may be chosen for insertion before or after the audio presentation for the current content item. The segue may be based on a music file or a portion thereof. The must file may be a network accessible music file or a file local to the client device that is uploaded or otherwise proved to the audio program server. As shown in FIG. 5, segues have been inserted between types of content. A segue 504 precedes the email message 506-510, another segue 512 precedes the social network updates 514, 516, and a final segue precedes the news articles 520-526. in some embodiments, segues may be inserted between individual items of a single content type, such as between each of the various email messages 506-510. Different music files or other audio may be used for different segues, as shown in FIG. 5. Segues 504, 518 are based on music file 1, while segue 512 is based on music file 2.

At block 416, the audio program server 102 may determine whether there are additional content items to process and include in the audio program. If there are, the process may return to block 404 for each additional content item. Otherwise, the process 400 may proceed to block 418.

At block 418, a summary of the audio program may be generated for insertion at the beginning and/or end of the audio program. The summary may include a simple count of each type of content or content source. The summary may also be more descriptive and include brief summaries of certain content, as generated buy NLU algorithms and described above. The summary may be processed by the text preprocessor 122 and the TTS engine 124.

At block 420, the audio presentation of the summary may be assembled with the audio presentations of the content items into an audio program. The audio program may be a single file or stream, or it may include multiple files or streams and data regarding playback (e.g.: a playlist). The assembled audio program may then be provided to user according to the user's preferred delivery method.

Terminology

Depending on the embodiment, certain acts, events, or functions of any of the processes or algorithms described herein can be performed in a different sequence, can be added, merged, or left out all together (e.g., not all described operations or events are necessary for the practice of the algorithm). Moreover, in certain embodiments, operations or events can be performed concurrently, e.g., through multi-threaded processing, interrupt processing, or multiple processors or processor cores or on other parallel architectures, rather than sequentially.

The various illustrative logical blocks, modules, routines, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The steps of a method, process, routine, or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of a non-transitory computer-readable storage medium. An exemplary storage medium can be coupled to the processor such that the processor can read information from, and write information to, the storage medium. In the alternative, the storage medium can be integral to the processor. The processor and the storage medium can reside in an ASIC. The ASIC can reside in a user terminal. In the alternative, the processor and the storage medium can reside as discrete components in a user terminal.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y and Z," unless specifically stated otherwise, is to be understood with the context as used in general to convey that an item, term, etc. may be either X, Y, or Z, or a combination thereof. Thus, such conjunctive language is not generally intended to imply that certain embodiments require at least one of X, at least one of Y and at least one of Z to each be present.

While the above detailed description has shown, described, and pointed out novel features as applied to various embodiments, it can be understood that various omissions, substitutions, and changes in the form and details of the devices or algorithms illustrated can be made without departing from the spirit of the disclosure. As can be recognized, certain embodiments of the inventions described herein can be embodied within a form that does not provide all of the features and benefits set forth herein, as some features can be used or practiced separately from others. The scope of certain inventions disclosed herein is indicated by the appended claims rather than by the foregoing description. All changes which come within the meaning and range of equivalency of the claims are to be embraced within their scope.

What is claimed is:

1. A system comprising:

one or more processors;

a computer-readable memory; and a module comprising computer executable instructions stored in the memory, wherein the one or more processors, when executing the module, are configured to:

receive, from a client device, user selection data regarding a first content source and a second content source, wherein the first content source is different from the second content source;

retrieve a first content item from the first content source and a second content item from the second content source;

determine, based at least in part on an association between a characteristic of the first content item and a characteristic of first voice data, to use the first voice data to generate a first text-to-speech presentation of the first content item;

determine, based at least in part on an association between a characteristic of the second content item and a characteristic of second voice data, to use the second voice data to generate a second text-to-speech presentation of the second content item;

generate the first text-to-speech presentation of the first content item based at least in part on the first voice data;

generate the second text-to-speech presentation of the second content item based at least in part on the second voice data;

assemble an audio program comprising the first text-to-speech presentation and the second text-to-speech presentation; and transmit the audio program to the client device.

2. The system of claim 1, wherein the one or more processors are further configured to include, in the audio program, a segue between the first text-to-speech presentation and the second text-to-speech presentation, the segue comprising user-selected music.

3. The system of claim 1, wherein the one or more processors are further configured to:

generate an audio presentation of a summarization of the audio program, wherein the audio program further comprises the audio presentation.

4. The system of claim 1, wherein the one or more processors are further configured to:

receive, from the client device, authentication information associated with the first content source, wherein the authentication information is presented to the first content source to retrieve the first content item.

5. The system of claim 1, wherein a characteristic of the first voice data comprises at least one of an age of a speaker, a gender of the speaker, or a speaking rate of the speaker.

6. A computer-implemented method comprising:

retrieving a first content item from a first content source and a second content item from a second content source, wherein the first content source is different from the second content source;

identifying first text-to-speech voice data based at least in part on a characteristic of the first content item;

determining that the second content item comprises a first portion and a second portion;

identifying second text-to-speech voice data and third text-to-speech voice data based at least in part on a characteristic of the second content item, wherein the first text-to-speech voice data is different from the second text-to-speech voice data;

generating a first audio presentation of the first content item utilizing the first text-to-speech voice data;

generating a second audio presentation of the second content item utilizing the second text-to-speech voice data with the first portion, and using the third text-to-speech voice data with the second portion; and assembling an audio program comprising the first audio presentation and the second audio presentation.

7. The computer-implemented method of claim 6, wherein the second content item comprises a quotation, wherein the first portion does not comprise the quotation, and wherein the second portion comprises the quotation.

8. The computer-implemented method of claim 6, wherein the second content item comprises an interview, wherein the first portion corresponds to an interviewer, and wherein the second portion corresponds to an interviewee.

9. The computer-implemented method of claim 6, wherein the audio program comprises streaming audio and wherein the streaming audio comprises the first audio presentation and the second audio presentation.

10. The computer-implemented method of claim 6, wherein assembling the audio program comprises placing a segue between the first audio presentation and the second audio presentation.

11. The computer-implemented method of claim 10, wherein the segue comprises at least a portion of a music recording, and wherein the portion is obtained from a client device or from a network-accessible music server.

12. The computer-implemented method of claim 6, wherein assembling the audio program comprises:

determining a summary of the audio program;

generating a third audio presentation of the summary; and including the third audio presentation in the audio program.

13. The computer-implemented method of claim 6, further comprising:

receiving, from a client device, authentication information associated with the first content source, wherein retrieving the first content item comprises presenting the authentication information to the first content source.

14. The computer-implemented method of claim 6, wherein the first characteristic comprises at least one of a subject matter, a vocabulary, a length, a source, or an author.

15. The computer-implemented method of claim 6, further comprising:

identifying a speaker gender, a speaker age, or a speaker voice speed based at least in part on the characteristic of the first content item, wherein identifying the first text-to-speech voice data is further based at least in part on the speaker gender, speaker age, or speaker voice speed.

16. The computer-implemented method of claim 6, wherein generating a first audio presentation of the first content item comprises:

summarizing the first content item, wherein the summarization is based on natural language understanding (NLU); and generating a first audio presentation of the summarization.

17. The computer-implemented method of claim 6, further comprising:

receiving tag data from a client device, wherein the tag data indicates a content item to tag; and tagging the content item indicated by the tag data.

18. A non-transitory computer readable medium comprising executable code that, when executed by a processor, causes a server computing system comprising one or more computing devices to perform a process comprising:

retrieving a first content item from a first content source and a second content item from a second content source, wherein the first content source is different from the second content source;

identifying first text-to-speech voice data based at least partly on an association between the first text-to-speech voice data and a characteristic of the first content item;

generating a first audio presentation of the first content item utilizing the first text-to-speech voice data;

identifying second text-to-speech voice data based at least partly on an association between the second text-to-speech voice data and a characteristic of the second content item;

generating a second audio presentation of the second content item utilizing second text-to-speech voice data; and assembling an audio program comprising the first audio presentation and the second audio presentation.

19. The non-transitory computer readable medium of claim 18 wherein the first content item and the second content item are retrieved based at least in part on user selection data.

20. The non-transitory computer readable medium of claim 18, wherein the characteristic of the first content item comprises one of a subject matter, a vocabulary, a length, a source, or an author.

21. The non-transitory computer readable medium of claim 19, wherein the association between the first text-to-speech voice data and the characteristic of the first content item comprises a previous determination that a text-to-speech presentation of a content item having the characteristic of the first content item is to be generated using a text-to-speech voice having a voice characteristic of the first text-to-speech voice data.

22. The non-transitory computer readable medium of claim 18, further comprising:

identifying second text-to-speech voice data and third text-to-speech voice data based at least in part on a characteristic of the second content item;

in response to determining that the second text-to-speech voice data comprises the first text-to-speech voice data, generating the second audio presentation based at least in part on the third text-to-speech voice data; and in response to determining that the second text-to-speech voice data does not comprise the first text-to-speech voice data, generating the second audio presentation based at least in part on the second text-to-speech voice data.

23. The non-transitory computer readable medium of claim 18, wherein assembling the audio program comprises placing a segue between the first audio presentation and the second audio presentation.

24. The non-transitory computer readable medium of claim 23, wherein the segue comprises at least a portion of a music recording, and wherein the portion is obtained from the client device or from a network-accessible music server.

25. The non-transitory computer readable medium of claim 18, wherein assembling the audio program comprises:

determining a summary of audio program;

generating a third audio presentation of the summary; and including the third audio presentation in the audio program.

26. The non-transitory computer readable medium of claim 18, further comprising:

receiving, from a client device, first authentication information associated with the first content source, wherein retrieving the first content item comprises presenting the authentication information to the first content source.

27. The system of claim 1, wherein the association between the characteristic of the first content item and the characteristic of the first voice data comprises a previous determination that a text-to-speech presentation of a content item having the characteristic of the first content item is to be generated using a text-to-speech voice having the characteristic of the first voice data.

28. The system of claim 1, wherein the one or more processors are further configured to determine the characteristic of the first content item by analyzing at least one of: textual content of the first content item, data regarding the first content source, or data regarding an author of the first content item.

29. The system of claim 1, wherein the characteristic of the first content item comprises at least one of a subject matter, a vocabulary, a length, a source, or an author.

30. The non-transitory computer readable medium of claim 21, wherein the voice characteristic comprises one of an age of a speaker, a gender of the speaker, or a speaking rate of the speaker.

31. The non-transitory computer readable medium of claim 18, wherein the executable code further causes the server computing system to perform a process comprising determining the characteristic of the first content item by analyzing at least one of: textual content of the first content item, data regarding the first content source, or data regarding an author of the first content item.

* * * * *

UNITED STATES PATENT AND TRADEMARK OFFICE

CERTIFICATE OF CORRECTION

PATENT NO. : 9,190,049 B2
APPLICATION NO. : 13/720873
DATED : November 17, 2015
INVENTOR(S) : Kaszczuk et al.

It is certified that error appears in the above-identified patent and that said Letters Patent is hereby corrected as shown below:

In the Claims

In column 14 at line 45, In Claim 18, change "utilizing" to --utilizing the--.

Signed and Sealed this
Twenty-eighth Day of June, 2016

Michelle K. Lee

Michelle K. Lee
*Director of the United States Patent and Trademark Office*